US012781965B1

(12) United States Patent
Nagarajan et al.

(10) Patent No.: US 12,781,965 B1
(45) Date of Patent: Nov. 3, 2026

(54) FUEL FLEXIBLE CO-SWIRL PREMIXER SUITABLE FOR HYDROGEN, NATURAL GAS AND LIQUID FUELS

(71) Applicant: General Electric Company, Evendale, OH (US)

(72) Inventors: Baladandayuthapani Nagarajan, Chennai (IN); Ajoy Patra, Bengaluru (IN); Pradeep Naik, Bengaluru (IN)

(73) Assignee: General Electric Company, Evendale, OH (US)

( * ) Notice: Subject to any disclaimer, the term of this patent is extended or adjusted under 35 U.S.C. 154(b) by 0 days.

(21) Appl. No.: 19/333,712

(22) Filed: Sep. 19, 2025

(30) Foreign Application Priority Data

Jun. 18, 2025 (IN) ..... 202511058452

(51) Int. Cl.
*F23R 3/28* (2006.01)
*F23C 7/00* (2006.01)
*F23R 3/14* (2006.01)

(52) U.S. Cl.
CPC ..... *F23R 3/286* (2013.01); *F23C 7/004* (2013.01); *F23R 3/14* (2013.01); *F23C 2900/07001* (2013.01)

(58) Field of Classification Search
CPC .. F23R 3/28; F23R 3/283; F23R 3/286; F23R 3/12; F23R 3/14; F23C 2900/07001; F23C 7/002; F23C 7/004
See application file for complete search history.

(56) References Cited

U.S. PATENT DOCUMENTS 5,165,241 A * 11/1992 Joshi ..... F23R 3/14 60/737
5,251,447 A 10/1993 Joshi et al.
5,351,477 A 10/1994 Joshi et al.
5,511,375 A 4/1996 Joshi et al.
5,613,363 A * 3/1997 Joshi ..... F23R 3/286 60/737
5,647,538 A * 7/1997 Richardson ..... F23D 11/101 239/419
5,675,971 A * 10/1997 Angel ..... F23R 3/286 60/737
5,816,049 A 10/1998 Joshi
6,038,864 A 3/2000 Prade et al.
6,070,411 A * 6/2000 Iwai ..... F23D 23/00 60/737
6,141,967 A 11/2000 Angel et al.
7,090,205 B2 * 8/2006 Oda ..... F23R 3/30 60/737
7,237,384 B2 * 7/2007 Stuttaford ..... F23R 3/14 60/737

(Continued)

FOREIGN PATENT DOCUMENTS

CN 116878027 A * 10/2023 ..... F23R 3/283

*Primary Examiner* — Alain Chau
(74) *Attorney, Agent, or Firm* — Carter, DeLuca & Farrell LLP

(57) ABSTRACT

A premixer for a combustor of a turbine engine is configured to allow gas turbines originally designed for use with natural gas or liquid fuels to operate using hydrogen fuel or a blend of hydrogen and other fuels to minimize CO and NOx emissions for cleaner combustion. The premixer includes a co-swirl swirler body, a splitter plate, a liquid fuel injecting center body, and radially and axially spaced fuel injection orifices to provide optimal mixing of fuel to optimize combustion.

20 Claims, 8 Drawing Sheets

(56) References Cited

U.S. PATENT DOCUMENTS

| | | | | |
|---|---|---|---|---|
| 7,434,401 | B2 * | 10/2008 | Hayashi | F23R 3/286 60/743 |
| 8,266,911 | B2 | 9/2012 | Evulet | |
| 8,297,057 | B2 * | 10/2012 | Toon | F23R 3/343 60/746 |
| 8,671,690 | B2 * | 3/2014 | Ishizaka | F23R 3/14 60/737 |
| 9,441,836 | B2 * | 9/2016 | Cohen | F23R 3/28 |
| 9,835,334 | B2 * | 12/2017 | Ryon | F23D 11/383 |
| 10,082,294 | B2 | 9/2018 | Laster et al. | |
| 10,794,596 | B2 | 10/2020 | Dai et al. | |
| 11,761,633 | B2 | 9/2023 | Shin | |
| 11,920,525 | B2 | 3/2024 | Snyder | |
| 12,181,152 | B1 | 12/2024 | Dai et al. | |
| 12,422,143 | B1 * | 9/2025 | Boardman | F23R 3/286 |
| 2004/0035386 | A1 * | 2/2004 | Sanders | F23R 3/32 123/305 |
| 2005/0039456 | A1 * | 2/2005 | Hayashi | F23D 11/107 60/737 |
| 2005/0127537 | A1 * | 6/2005 | Oda | F23R 3/30 261/78.1 |
| 2006/0162337 | A1 * | 7/2006 | Stuttaford | F23R 3/286 60/776 |
| 2007/0003897 | A1 | 1/2007 | Koizumi et al. | |
| 2008/0163627 | A1 * | 7/2008 | ELKady | F23R 3/14 60/737 |
| 2009/0173076 | A1 * | 7/2009 | Toon | F23R 3/343 60/746 |
| 2013/0232978 | A1 * | 9/2013 | Dai | F23R 3/28 60/737 |
| 2017/0082288 | A1 * | 3/2017 | Ryon | F23R 3/286 |
| 2019/0078784 | A1 * | 3/2019 | Tentorio | F23D 11/383 |
| 2019/0137103 | A1 * | 5/2019 | Choi | F23R 3/286 |
| 2021/0010674 | A1 * | 1/2021 | Thariyan | F23R 3/14 |
| 2024/0369225 | A1 * | 11/2024 | Ito | F23R 3/002 |
| 2025/0283602 | A1 * | 9/2025 | Boardman | F23R 3/286 |

* cited by examiner

FUEL FLEXIBLE CO-SWIRL PREMIXER SUITABLE FOR HYDROGEN, NATURAL GAS AND LIQUID FUELS

TECHNICAL FIELD

This disclosure relates to a turbine engine with a combustor, and more specifically to a combustor for a turbine engine having a premixer with low emissions and liquid fuel capability.

BACKGROUND

Turbine engines, and particularly gas or combustion turbine engines, are rotary engines that extract energy from a flow of combusted gases passing through the engine and flowing over a multitude of stationary and rotating turbine blades to produce mechanical energy. Typically, gas or combustion turbine engines use carbon-based fuels which emit harmful pollutants into the atmosphere, such as nitrogen oxide and nitrogen dioxide (collectively called NOx), carbon monoxide (CO), unburned hydrocarbons (UHC) (e.g., methane and volatile organic compounds that contribute to the formation of atmospheric ozone), and other oxides, including oxides of sulfur (e.g., $SO_2$ and $SO_3$).

BRIEF DESCRIPTION OF THE DRAWINGS

A better understanding of the features and advantages of the disclosed technology will be obtained by reference to the following detailed description that sets forth illustrative aspects, in which the principles of the technology are utilized, and the accompanying drawings of which.

Figure 1:
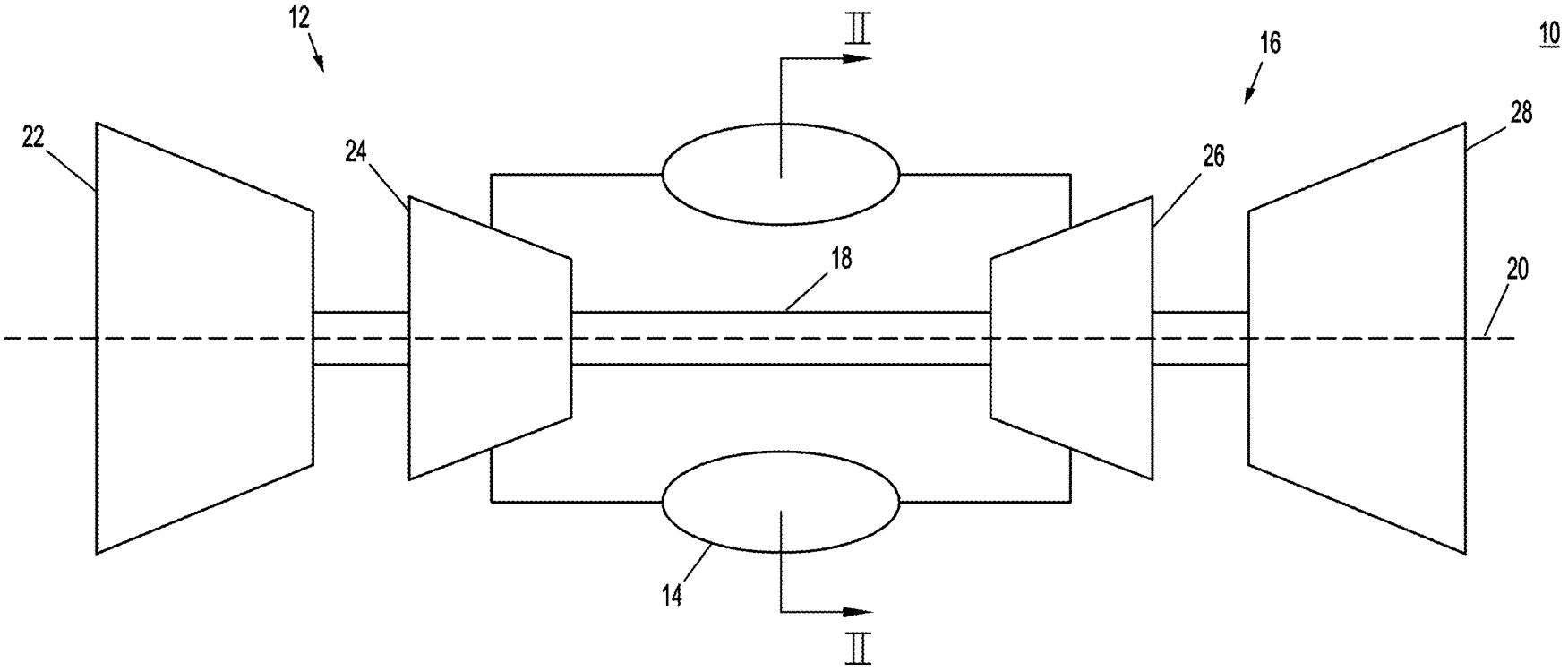
FIG. 1 is a schematic view of a turbine engine having a compression section, a combustion section, and a turbine section in accordance with various aspects of the disclosure.

Further exemplary aspects of the disclosure are described in more detail below with reference to the appended figures. Aspects of this disclosure may be combined without departing from the scope of the disclosure.

DETAILED DESCRIPTION

Reference will now be made in detail to aspects of the disclosure, one or more examples of which are illustrated in the accompanying drawings. The detailed description uses numerical and letter designations to refer to features in the drawings. Like or similar designations in the drawings and description have been used to refer to like or similar parts of the disclosure.

The word "exemplary" is used herein to mean "serving as an example, instance, or illustration." Any implementation described herein as "exemplary" is not necessarily to be construed as preferred or advantageous over other implementations. Additionally, unless specifically identified otherwise, all aspects described herein should be considered exemplary.

The terms "upstream" and "downstream" refer to the relative direction with respect to fluid flow in a fluid pathway. For example, "upstream" refers to the direction from which the fluid flows, and "downstream" refers to the direction to which the fluid flows.

All directional references (e.g., radial, axial, proximal, distal, upper, lower, upward, downward, left, right, lateral, front, back, top, bottom, above, below, vertical, horizontal, clockwise, counterclockwise, upstream, downstream, forward, aft, etc.) are only used for identification purposes to aid the reader's understanding of the disclosure, and do not create limitations, particularly as to the position, orientation, or use of aspects of the disclosure described herein. Connection references (e.g., attached, coupled, connected, and joined) are to be construed broadly and can include intermediate structural elements between a collection of elements and relative movement between elements unless otherwise indicated. Accordingly, connection references do not necessarily imply that two elements are directly connected and in fixed relation to one another. The exemplary drawings are for purposes of illustration only and the dimensions, positions, order and relative sizes reflected in the drawings attached hereto can vary.

As used herein, the terms "first," "second," "third," etc. may be used interchangeably to distinguish one component from another and are not intended to signify location or importance of the individual components. Unless otherwise specified or understood based on their context of use, such descriptors are not intended to impute any meaning of priority, physical order or arrangement in a list, or ordering in time but are merely used as labels for referring to multiple elements or components separately for ease of understanding the disclosed examples. In some examples, the descriptor "first" may be used to refer to an element in the detailed description, while the same element may be referred to in a claim with a different descriptor such as "second" or "third." In such instances, such descriptors are used merely for ease of referencing multiple elements or components.

The terms "coupled," "fixed," "attached to," and the like refer to both direct coupling, fixing, or attaching, as well as indirect coupling, fixing, or attaching through one or more intermediate components or features, unless otherwise specified herein.

The singular forms "a," "an," and "the" include plural references unless the context clearly dictates otherwise.

Although this disclosure will be described in terms of specific aspects, it will be readily apparent to those skilled in this art that various modifications, rearrangements, and substitutions may be made without departing from the spirit of this disclosure.

For purposes of promoting an understanding of the principles of this disclosure, reference will now be made to exemplary aspects illustrated in the drawings, and specific language will be used to describe the same. It will nevertheless be understood that no limitation of the scope of this disclosure is thereby intended. Any alterations and further modifications of the inventive features illustrated herein, and any additional applications of the principles of this disclosure, as illustrated herein, which would occur to one skilled in the relevant art and having possession of this disclosure, are to be considered within the scope of this disclosure.

The aspects disclosed herein are examples of the disclosure and may be embodied in various forms. For instance, although certain aspects herein are described as separate aspects, each of the aspects herein may be combined with one or more of the other aspects herein. Specific structural and functional details disclosed herein are not to be interpreted as limiting, but as a basis for the claims and as a representative basis for teaching one skilled in the art to employ this disclosure in any appropriately detailed structure.

The phrases "in an aspect," "in aspects," "in various aspects," "in some aspects," "in other aspects," or the like, may each refer to one or more of the same or different aspects in accordance with this disclosure.

Approximating language, as used herein, is applied to modify any quantitative representation that could permissibly vary without resulting in a change in the basic function to which it is related. Accordingly, a value modified by a term or terms, such as "about," "approximately," "generally," and "substantially" is not to be limited to the precise value specified. In at least some instances, the approximating language may correspond to the precision of an instrument for measuring the value, or the precision of the methods or the machines for constructing the components and/or the systems or manufacturing the components and/or the systems. For example, the approximating language may refer to being within a one, two, four, ten, fifteen, or twenty percent margin in either individual values, range(s) of values and/or endpoints defining range(s) of values.

FIG. 1 is a schematic view of a turbine engine 10. As a non-limiting example, the turbine engine 10 can be used within an aircraft. The turbine engine 10 can include, at least, a compressor section 12, a combustion section 14, and a turbine section 16. The compressor section 12, the combustion section 14, and/or the turbine section 16 can be in an axial flow arrangement. The compressor section 12, the combustion section 14, or the turbine section 16 can define an axially extending engine centerline. A drive shaft 18 rotationally couples the compressor section 12 and turbine section 16, such that rotation of one affects the rotation of the other and defines a rotational axis 20 for the turbine engine 10.

The compressor section 12 can include a low-pressure (LP) compressor 22, and a high-pressure (HP) compressor 24 serially fluidly coupled to one another. The turbine section 16 can include an HP turbine 26 and an LP turbine 28 serially fluidly coupled to one another. The drive shaft 18 can operatively couple the LP compressor 22, the HP compressor 24, the HP turbine 26 and the LP turbine 28 together. Alternatively, the drive shaft 18 can include an LP drive shaft (not illustrated) and an HP drive shaft (not illustrated). The LP drive shaft can couple the LP compressor 22 to the LP turbine 28, and the HP drive shaft can couple the HP compressor 24 to the HP turbine 26. An LP spool can be defined as the combination of the LP compressor 22, the LP turbine 28, and the LP drive shaft such that the rotation of the LP turbine 28 can apply a driving force to the LP drive shaft, which in turn can rotate the LP compressor 22. An HP spool can be defined as the combination of the HP compressor 24, the HP turbine 26, and the HP drive shaft such that the rotation of the HP turbine 26 can apply a driving force to the HP drive shaft which in turn can rotate the HP compressor 24.

The compressor section 12 can include a plurality of axially spaced stages. Each stage includes a set of circumferentially spaced rotating blades and a set of circumferentially spaced stationary vanes. The compressor blades for a stage of the compressor section 12 can be mounted to a disk, which is mounted to the drive shaft 18. Each set of blades for a given stage can have its own disk. The vanes of the compressor section 12 can be mounted to a casing which can extend circumferentially to the turbine engine 10. It will be appreciated that the representation of the compressor section 12 is merely schematic and that there can be any number of stages. Further, it is contemplated that there can be any other number of components within the compressor section 12.

Similar to the compressor section 12, the turbine section 16 can include a plurality of axially spaced stages, with each stage having a set of circumferentially spaced, rotating blades and a set of circumferentially spaced, stationary vanes. The turbine blades for a stage of the turbine section 16 can be mounted to a disk which is mounted to the drive shaft 18. Each set of blades for a given stage can have its own disk. The vanes of the turbine section can be mounted to the casing in a circumferential manner. It is noted that there can be any number of blades, vanes and turbine stages as the illustrated turbine section is merely a schematic representation. Further, it is contemplated that there can be any other number of components within the turbine section 16.

The combustion section 14 can be provided serially between the compressor section 12 and the turbine section 16. The combustion section 14 can be fluidly coupled to at least a portion of the compressor section 12 and the turbine section 16 such that the combustion section 14 at least partially fluidly couples the compressor section 12 to the turbine section 16. As a non-limiting example, the combustion section 14 can be fluidly coupled to the HP compressor 24 at an upstream end of the combustion section 14 and to the HP turbine 26 at a downstream end of the combustion section 14.

During operation of the turbine engine 10, ambient or atmospheric air is drawn into the compressor section 12 via a fan (not illustrated) upstream of the compressor section 12, where the air is compressed to form a pressurized air. The pressurized air can then flow into the combustion section 14 where the pressurized air is mixed with fuel, ignited, and burned, thereby generating combustion gases. Work is extracted from the combustion gases by the HP turbine 26 as the combustion gases flow through the HP turbine 26, and the HP turbine drives the HP compressor 24. The combustion gases are discharged from the HP turbine 26 into the LP turbine 28, which extracts additional work from the combustion gases to drive the LP compressor 22. Exhaust gases are ultimately discharged from the turbine engine 10 via an exhaust section (not illustrated) of the turbine engine 10 downstream of the turbine section 16. The driving of the LP turbine 28 drives the LP spool to rotate the fan (not illustrated) and the LP compressor 22. The pressurized airflow and the combustion gases can together define a working airflow that flows through the fan, compressor section 12, combustion section 14, and turbine section 16 of the turbine engine 10.

Figure 2:
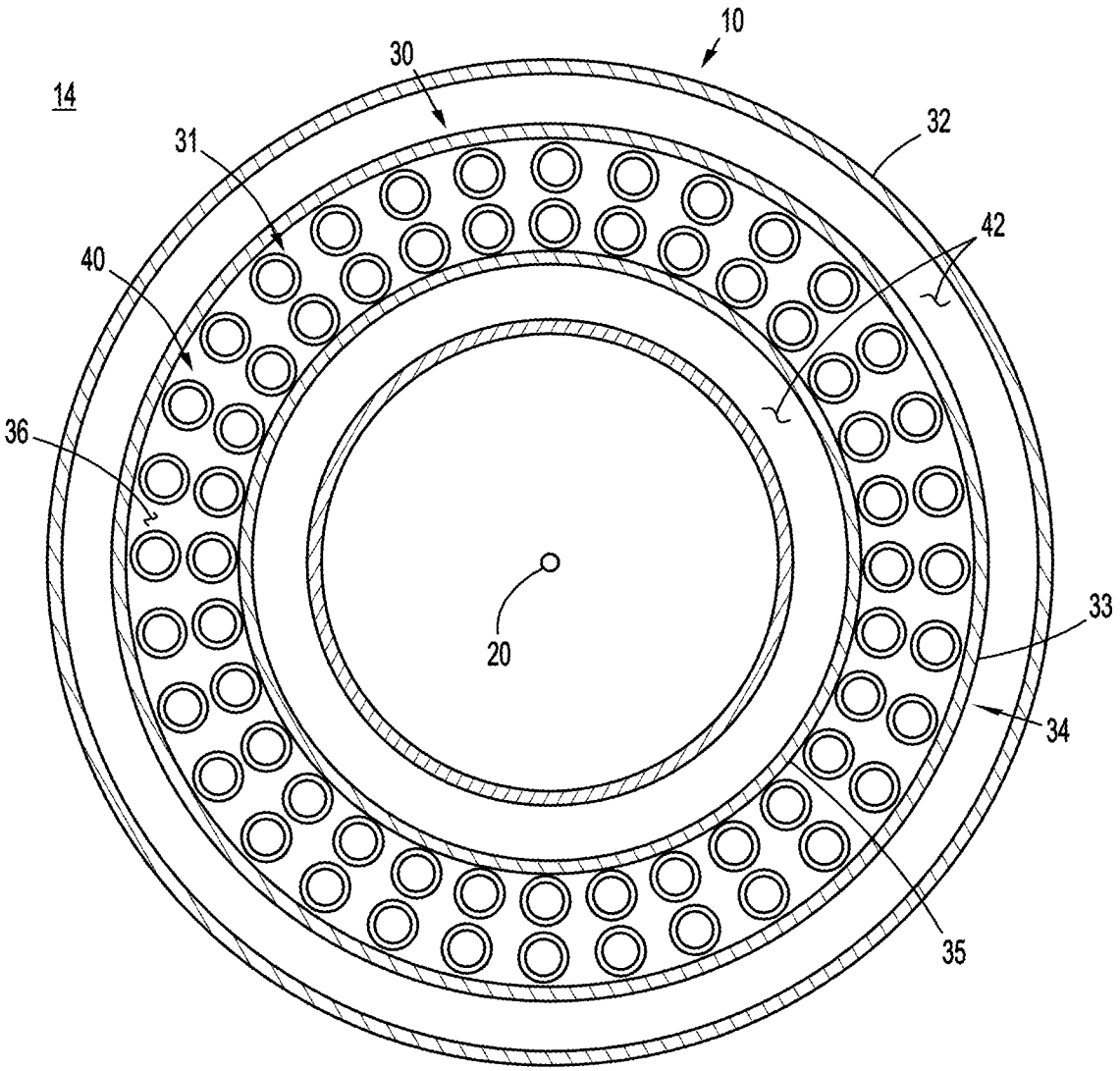
FIG. 2 is a cross-sectional view of the combustion section of FIG. 1 taken along line II-II.

FIG. 2 depicts a cross-sectional view of the combustion section 14 of the turbine engine 10 along line II-II of FIG. 1. The combustion section 14 can include a combustor 30 with an annular arrangement of fuel cups, pre-mixers, fuel-air mixers, or fuel nozzles 31 disposed around the centerline or rotational axis 20 of the turbine engine 10. It should be appreciated that the annular arrangement of the fuel cups or fuel nozzles 31 can be one or multiple fuel nozzles, and one or more of the fuel nozzles 31 can have different characteristics. The combustor 30 can have a can, can-annular, or annular arrangement depending on the type of engine in which the combustor 30 is located. In a non-limiting example, the combustor 30 can have a combination arrangement located with a casing 32 of the engine.

The combustor 30 can be at least partially defined by a combustor liner 34. The combustor liner 34 can be a combustor casing, a flame tube, or include multiple layers of casings or liners. That is, the combustor liner 34 can define at least a portion of a combustion chamber or volume for a can, can-annular, or annular arrangement combustor.

In some examples, the combustor liner 34 can include an outer liner 33 and an inner liner 35 concentric with respect to each other and arranged in an annular fashion about the engine centerline or rotational axis 20. In some examples, the combustor liner 34 can have an annular structure about the combustor 30. In some examples, the combustor liner 34 can include multiple segments or portions collectively forming the combustor liner 34. A dome assembly 36 together with the combustor liner 34 can at least partially define a combustion chamber 40 arranged annularly about the rotational axis 20. A compressed air passage 42 can be defined at least in part by both the combustor liner 34 and the casing 32.

Figure 3:
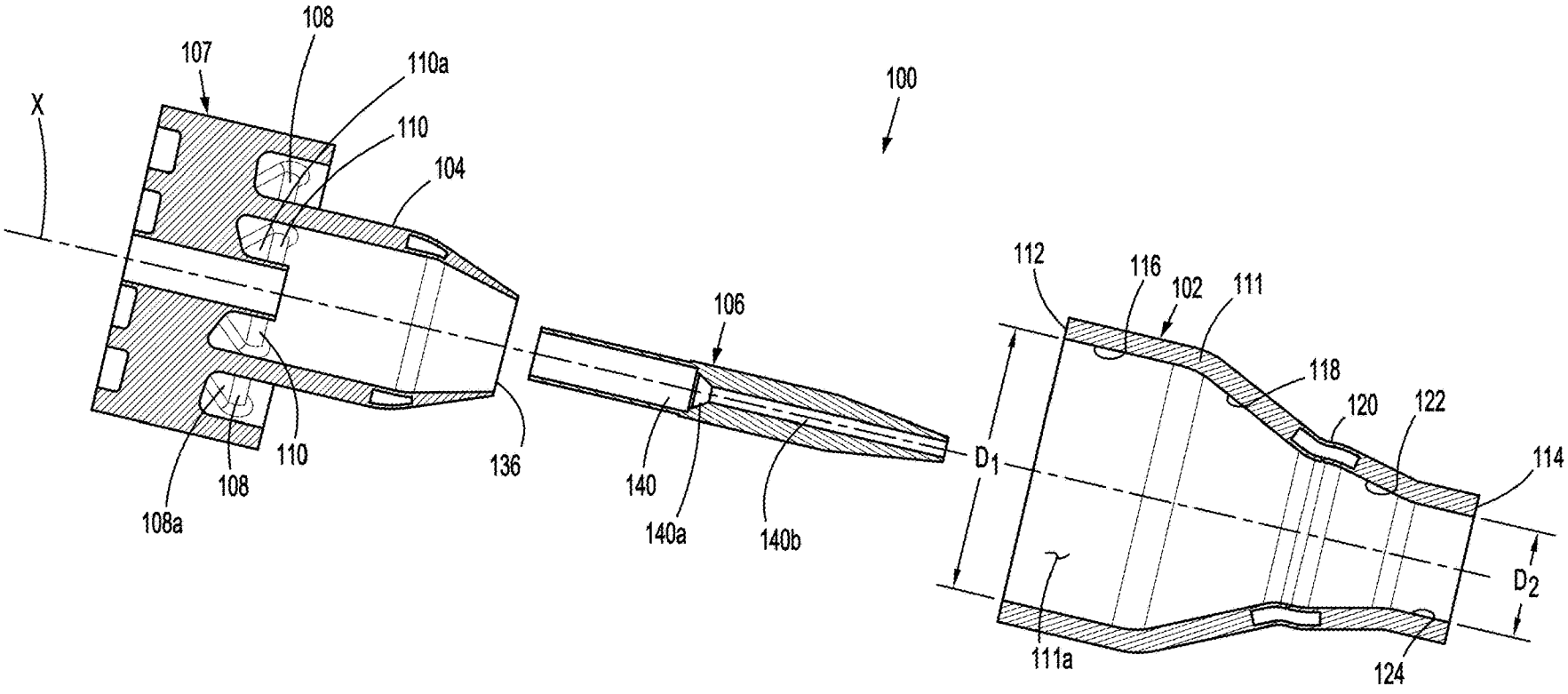
FIG. 3 is an exploded, side cross-sectional view of a premixer of the combustion section of the turbine engine shown in FIG. 2.
Figure 4:
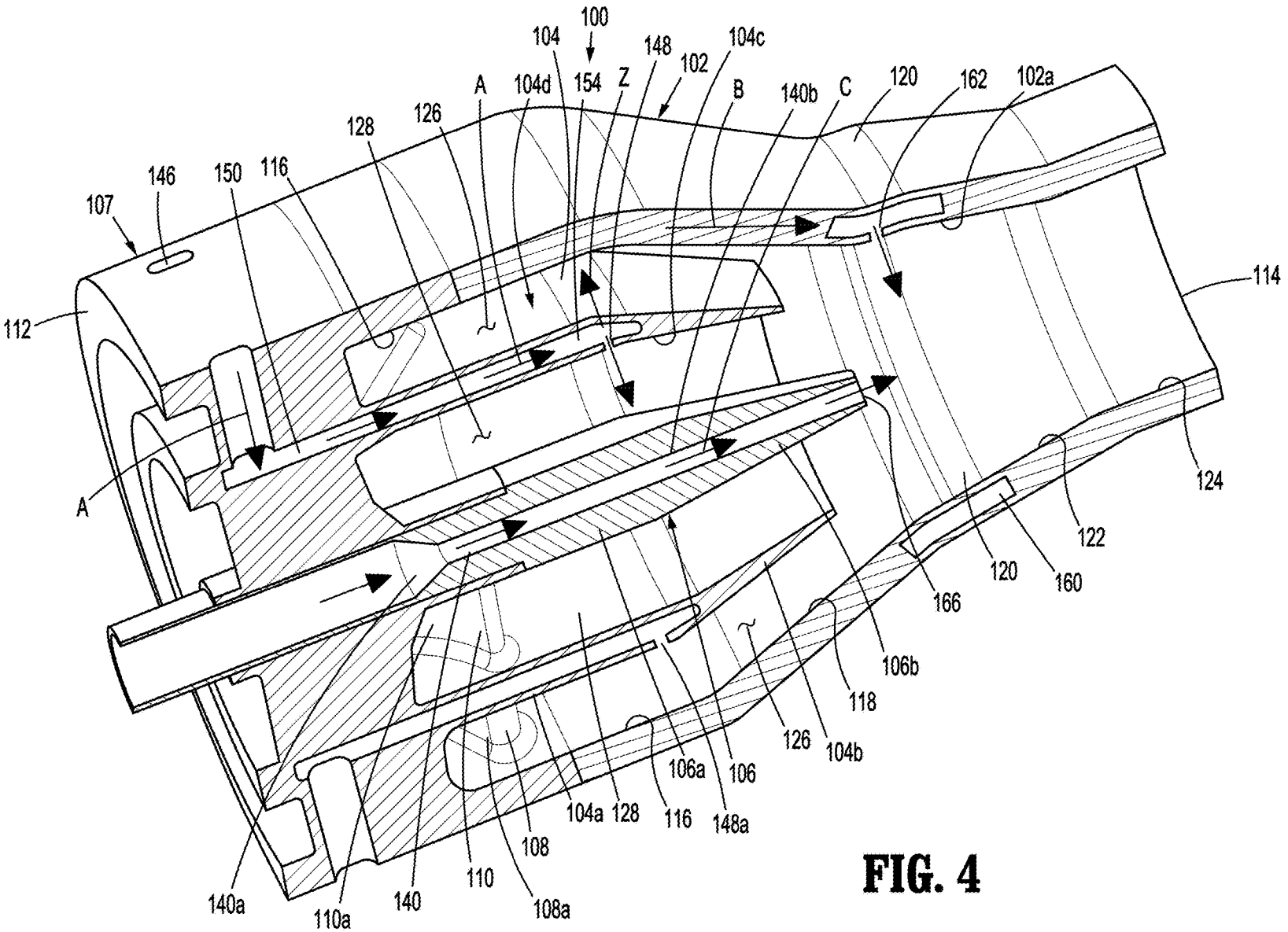
FIG. 4 is a side cross-sectional view of the premixer shown in FIG. 3 assembled.

FIGS. 3 and 4 illustrate a co-swirl premixer 100 of the combustion section 14 of the turbine engine 10 of FIG. 1 according to aspects of the disclosure. The combustion section 14 of the turbine engine may include a plurality of premixers 100 to promote the uniform mixing of fuel and air upstream of the combustion chamber and provide for fuel versatility. The uniform mixing of the fuel and air helps to minimize the formation of pollutants, such as $NO_x$ and CO produced during the combustion of the fuel/air mixture.

Each premixer 100 according to aspects of the disclosure includes an outer shroud 102, a splitter plate 104, a center body 106, and a swirler body 107 including outer swirlers 108, and inner swirlers 110. The outer and inner swirlers 108 and 110 create two swirling flows of air for optimal mixing of fuel and air before combustion. In aspects of the disclosure, the outer swirler 108 and the inner swirler 110 can be counter swirlers to enhance mixing and lower emissions. The premixer 100 defines a longitudinal axis "X" and the outer shroud 102 includes a body 111 having an inlet end 112 with an inlet diameter $D_1$ and an exit end 114 with an exit diameter $D_2$ that is smaller than the inlet diameter $D_1$. The body 111 defines a channel 111*a* (FIG. 3) that extends from the inlet end 112 to the exit end 114. The splitter plate 104 and the center body 106 are secured within the outer shroud 102 and extend from the outer and inner swirlers 108 and 110 towards the exit end 114. The outer and inner swirlers 108 and 110 are positioned adjacent the inlet end 112 of the premixer 100, and the splitter plate 104 separates the outer swirler 108 from the inner swirler 110. The center body 106 is positioned along the longitudinal axis "X" of the outer shroud 102 radially inward of the outer and inner swirlers 108 and 110 and the splitter plate 104.

In aspects of the disclosure, the outer shroud 102 includes a first constant diameter section 116 that extends from the outer and inner swirlers 108 and 110 towards the exit end 114, a first converging diameter section 118 that extends from the constant diameter section 116 towards the exit end 114, a second constant diameter section 120 that extends from the first converging diameter section 118 towards the exit end 114, a second converging diameter section 122 that extends from the second constant diameter section 120 towards the exit end 114, and a third constant diameter section 124 that extends from the second converging diameter section 122 to the exit end 114 of the premixer 100. The first constant diameter section 116 is positioned downstream of the outer and inner swirlers 108 and 110 and extends from the outer and inner swirlers 108 and 110 to the first converging diameter section 118. In aspects of the disclosure, the first constant diameter section 116 has a length of between about $D_2$ and about $2D_2$ to reduce the effects of wakes, or regions of disturbed air flow caused by the outer and inner swirlers 108 and 110. The third constant diameter section 124 helps the mixture flow to stabilize before entering the combustion section to avoid flashback.

The splitter plate 104 is positioned within the outer shroud 102 and extends circumferentially about the center body 106 to define an outer air flow channel 126 between the splitter plate 104 and the outer shroud 102 and an inner air flow channel 128 between the splitter plate 104 and the center body 106. In aspects of the disclosure, the splitter plate 104 is integrally formed with the swirler body 107. The outer swirler 108 is positioned upstream of the outer air flow channel 126 and the inner swirler 110 is positioned upstream of the inner air flow channel 128. The outer and inner swirlers 108 and 110 have swirler vanes 108*a* and 110*a* that have vane angles to achieve a swirl number at the exit end 114 of between about 0.35 and 0.50 and vane heights to achieve desired turbulence. In aspects of the disclosure, the vane heights of the outer and inner swirlers 108 and 110 can be between about 0.1 $D_2$ and about 0.25 $D_2$. Air is introduced into the outer and inner air flow channels 126 and 128 through the outer and inner swirlers 108 and 110. The higher swirl level enhances the mixing of fuel and air, whereas an appropriate swirl level stabilizes the flame within the combustion chamber. Efficient fuel and air mixing facilitated by swirling reduces NOx and CO emissions.

In aspects of the disclosure, the splitter plate 104 includes a constant diameter section 104*a* that is spaced radially inwardly of the first constant diameter section 116 of the outer shroud 102 and a converging diameter section 104*b* that is spaced radially inwardly of the first converging diameter section 118 of the outer shroud 102. In some aspects of the disclosure, the splitter plate 104 is extended towards the exit end 114 of the premixer 100 a distance to delay interaction between the air flows from the outer air flow channel 126 and the inner air flow channel 128 to reduce shear between the air flow jets and minimize the risk of flashback or uncontrolled ignition within the premixer 100. The extended length of the splitter plate 104 also enables the formation of a constant area section within the outer and inner air flow channels 126 and 128 to minimize wakes produced by the swirler vanes 108*a*, 110*a*.

In aspects of the disclosure, the converging diameter section 104*b* of the splitter plate 104 has a thickness that decreases towards the exit end of the premixer 100 to define a sharp trailing edge 136 that helps to reduce wake. In aspects of the disclosure, the sharp trailing edge 136 of the splitter plate 104 is positioned upstream of the second constant diameter section 120 of the outer shroud 102. The converging portions of the outer and inner air flow channels 126 and 128 defined between the converging diameter section 104*b* and the splitter plate 104 and the first converging diameter section 118 of the outer shroud 102 and the center body 106, respectively, accelerates the flow of air through the outer and inner air flow channels 126, 128 to reduce the risk of flashback.

The center body 106 is spaced radially inwardly from the splitter plate 104 and includes a constant diameter section

106*a* that extends from the inner swirlers 110 and a converging diameter section 106*b* that is radially spaced from the converging diameter section 104*b* of the splitter plate 104. The converging diameter section 106*b* of the center body 106 and the converging diameter section 104*b* of the splitter plate 104 define the converging portion of the inner air flow channel 128. The center body 106 defines a central flow channel 140 that has an inlet end with a converging diameter section 140*a* that communicates with a constant diameter section 140*b*.

In aspects of the disclosure, the swirler body 107 defines fuel inlets 146 and the splitter plate 104 defines first fuel orifices 148 that communicate with the fuel inlets 146 via a first fuel path 150. In some aspects of the disclosure, the first fuel path 150 extends from the fuel inlets 146, through swirler body 107, and through a portion of the splitter plate 104 to the first fuel orifices 148 to eject fuel from an inner surface 104*c* of the splitter plate 104. It is envisioned that fuel could also be directed through orifices 148*a* formed in the outer surface 104*d* (in the direction of arrow "Z") and/or inner surface 104*c* of the splitter plate 104. In some aspects of the disclosure, the first fuel orifices 148 are positioned in an annular array near a downstream end of the constant diameter section 104*a* of the splitter plate 104 where the velocity of the air is relatively lower to achieve fuel jet penetration that enhances fuel air mixing followed by the converging diameter section 104*b* to accelerate the mixture flow to avoid flashback. In certain aspects of the disclosure, the first fuel path 150 communicates with an annular fuel plenum 154 formed in the splitter plate 104 that communicates with each of the first fuel orifices 148. Alternately, a plurality of first fuel paths 150 can be provided to supply the first fuel to each of the first fuel orifices 148 in the direction of arrows "A" in FIG. 4. It is envisioned that the diameter, number, and angle can be selected to achieve a desired mixture of fuel and air.

In aspects of the disclosure, the outer shroud 102 defines a fuel plenum 160 that communicates with second fuel orifices 162 that exit into the outer shroud 102 of the premixer 100. In certain aspects of the disclosure, the second fuel orifices 162 are positioned in an annular array on an inner surface 102*a* of the body 111 of the outer shroud 102 and exit into the outer shroud 102 at or near the second constant diameter section 120 of the outer shroud 102 to achieve better jet penetration to enhance the fuel and air mixture followed by a converging diameter section to accelerate the mixture flow to prevent flashback. Although not shown, the outer shroud 102 defines a second fuel path (not shown) that communicates with the fuel plenum 160 to allow a second fuel to travel through the outer shroud 102 into the fuel plenum 160 in the direction of arrows "B" in FIG. 4.

The central flow channel 140 of center body 106 defines an air flow path for air to flow in the direction of arrows "C" to provide a strong air jet at the center of the premixer 100 to avoid any flashback.

The disclosed premixer 100 is designed to facilitate effective operation of a gas turbine engine using only hydrogen fuel. When the premixer 100 is used with only hydrogen fuel, air is delivered through the outer and inner air flow channels 126, 128 and central flow channel 140, and hydrogen fuel is supplied to the first fuel path 150 and to the second fuel path to simultaneously deliver hydrogen to the first fuel orifices 148 and to the second fuel orifices 162. The first fuel orifices 148 and the second fuel orifices 162 are radially and axially spaced from each other to deliver the hydrogen fuel more evenly across the premixer 100. This is important, especially with hydrogen, because hydrogen has a very high diffusivity, i.e., hydrogen spreads quickly within the air flow. By spacing the first fuel orifices 148 from the second fuel orifices 162, both radially and axially, the hydrogen fuel is spread more evenly across the premixer 100 to promote more uniform mixing which is necessary for stable, lean combustion and low emissions. Spacing the first fuel orifices 148 from the second fuel orifices 162 also minimizes the risk of flashback. More specifically, hydrogen flames are prone to flashback because of the high reactivity of the fuel. Spacing the first fuel orifices 148 from the second fuel orifices 162 minimizes the richness of the hydrogen fuel within the premixer 100 to help maintain a stable flame at a safe distance from the premixer 100. The premixer 100 produces a uniform mixing of the hydrogen fuel and air to provide a more consistent combustion with lower peak temperatures to reduce NOx formation. Finally, spacing the first fuel orifices 148 from the second fuel orifices 162 allows for staged combustion which allows some injectors to be operated at low loads and more injectors to be operated at higher loads to provide for engine flexibility and better performance over a wide operating range.

Hydrogen fuel has inherent characteristics that result in a shorter flame length. More specifically, hydrogen has the highest flame speed and reactivity than hydrocarbon fuels which means combustion occurs more quickly even at lean conditions such that the flame reaches a shorter physical distance.

Figure 5:
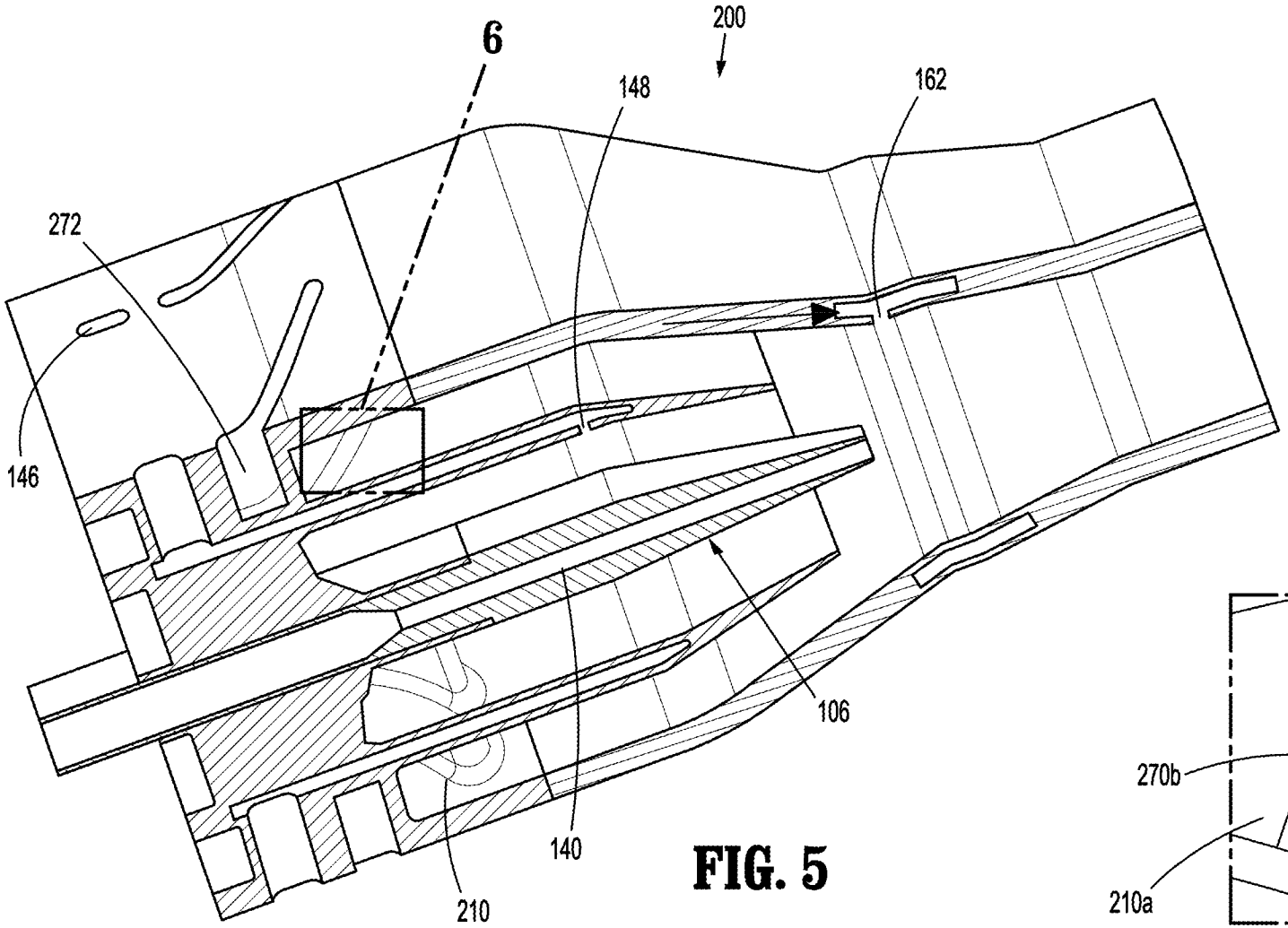
FIG. 5 is a side cross-sectional view of an alternate version of the premixer shown in FIG. 4 in accordance with various aspects of the disclosure.
Figure 6:
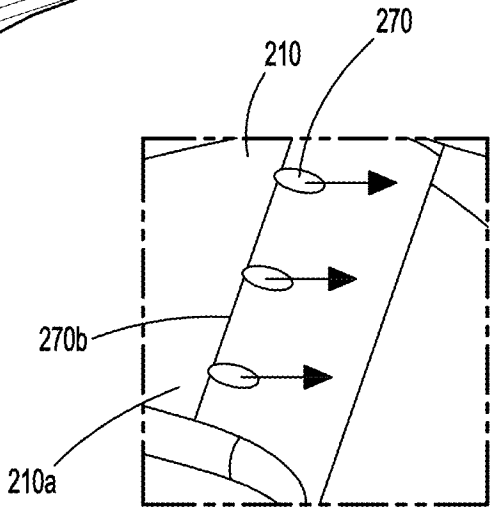
FIG. 6 is an enlarged view of the indicated area of detail shown in FIG. 5.

FIGS. 5 and 6 illustrate an alternate version of the premixer 100 shown generally as co-swirl premixer 200 which is like premixer 100 (FIGS. 3 and 4). The premixer 200 differs from the premixer 100 in that outer swirlers 210 of the premixer 200 include swirler vanes 210*a* that have fuel orifices 270 on or towards the leading edge 270*b* of the swirler vanes 210*a*. The premixer 200 also includes a fuel plenum 272 that communicates with the fuel orifices 270 in the swirler vanes 210*a*. The premixer 200 is designed to facilitate effective operation of a gas turbine engine using hydrogen, natural gas, and blended fuel (combination of natural gas with different % of hydrogen).

When the premixer 200 is used for natural gas or blended fuel (combination of natural gas with different % of hydrogen), the fuel is delivered to the second fuel orifices 162, the first fuel orifices 148 and the swirler vane fuel orifice 270. The different fuels can be selectively or independently delivered to the different fuel orifices 148, 162, and 270 based upon engine load to provide for engine flexibility and better performance over a wide operating range while minimizing CO and NOx emissions. The stability of the combustor can be improved by adjusting the flow through the second fuel orifices 162. When the premixer 200 is used for hydrogen only fuel, the fuel is supplied to the first fuel orifices 148 and to the second fuel orifices 162 simultaneously, as described above regarding the description mentioned for premixer 100.

Figure 7:
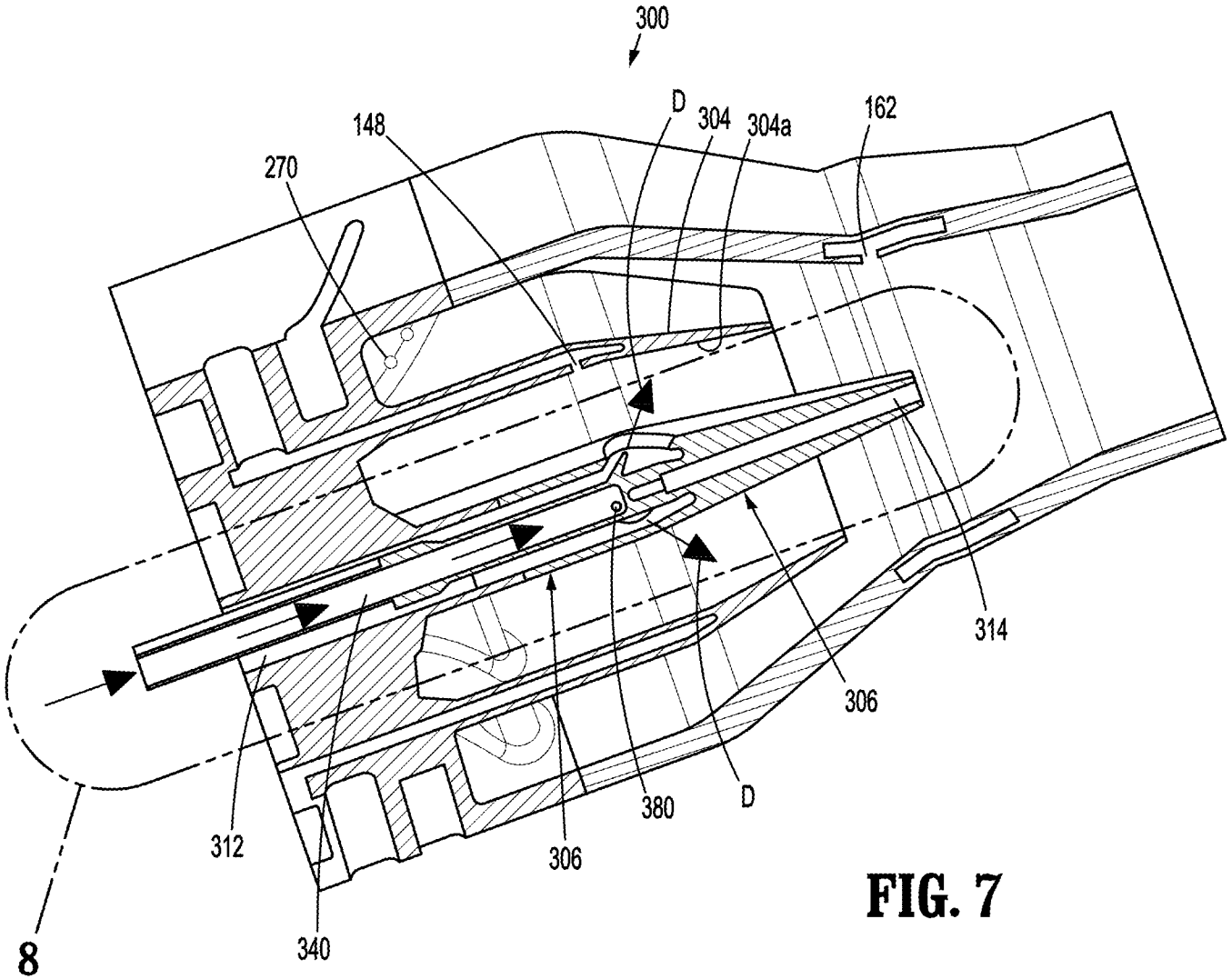
FIG. 7 is a side cross-sectional view of another alternate version of the premixers shown in FIGS. 4 and 5 in accordance with aspects of the disclosure.
Figure 8:
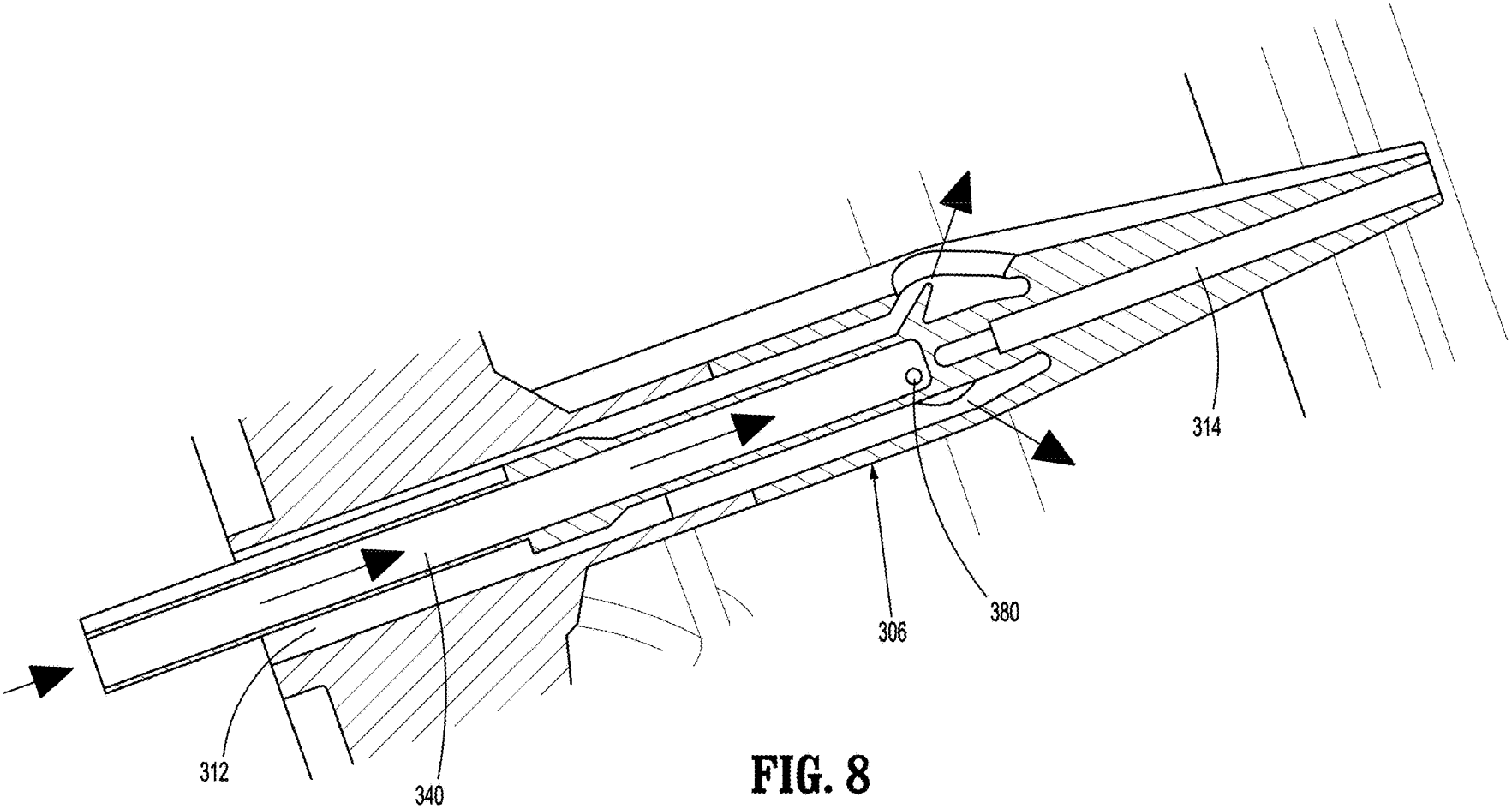
FIG. 8 is a side cross-sectional view of a center body of the premixer shown in FIG. 7.
Figure 9:
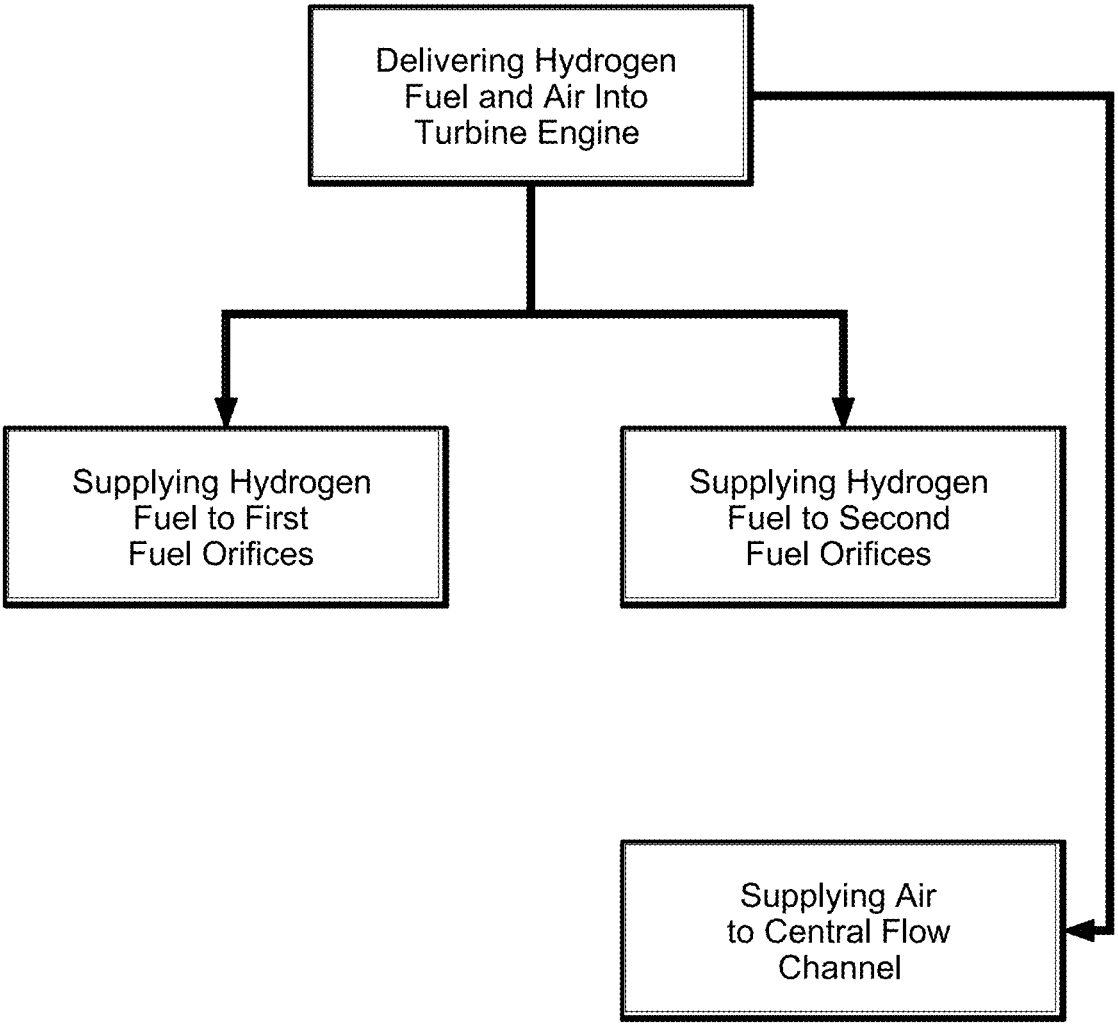
FIG. 9 is a flow chart illustrating the supply of hydrogen fuel to the premixer shown in FIG. 3.

FIG. 7 illustrates an alternate version of the premixer 200 shown generally as premixer 300. The premixer 300 is like the premixer 200 except the center body 106 of the premixer 200 is replaced with center body 306 to provide a liquid fuel path. The center body 306 (FIG. 8) is a center body that can deliver liquid fuel, e.g., Jet A, Jet A-1, or diesel. The co-swirl premixer 300 is designed to facilitate effective operation of a gas turbine engine using only hydrogen fuel, natural gas, and blended fuel (combination of natural gas with a different % of Hydrogen) and liquid fuel. The center body 306 includes a central fuel channel 340 that delivers fuel to fuel orifices 380. The fuel orifices 380 are angled outwardly from the longitudinal axis of the premixer 300 to direct fuel in the direction of arrows "D" towards the inner surface 304*a* of the splitter plate 304. When liquid fuel is ejected from the fuel orifices 380, the splitter plate 304 can operate as a pre-filmer for improved atomization of the fuel. More specifically, the impact of the fuel on the inner wall of the splitter plate 304 spreads the liquid fuel into a thin layer allowing the high-speed air flow to shear the layer of fuel into fine droplets to improve mixing and providing more complete combustion and lower CO and Nox emissions. The center body 306 also defines an annular air flow channel 312 that communicates with a central air passage 314 positioned downstream of the central fuel channel 340 to deliver a central flow of air to avoid flashback The channel 314 is as described above regarding central flow channel 140 of premixer 100.

When the premixer 300 is used for natural gas or blended fuel (combination of natural gas with different % of Hydrogen), the fuel is delivered to the second fuel orifices 162, the first fuel orifices 148 and the swirler vane fuel orifice 270. The different fuels can be selectively or independently delivered to the different fuel orifices 148, 270 and 162 based upon engine load to provide for engine flexibility and better performance over a wide operating range while minimizing CO and Nox emissions. Adjusting the second fuel orifice flow can improve the stability of the combustor. When the premixer 300 is used for hydrogen fuel, the fuel is supplied to the first fuel orifices 148 and to the second fuel orifices 162 simultaneously, as described above regarding premixer 100.

The premixers 100, 200, and 300 can be manufactured as a three-piece assembly. In aspects of the disclosure, the swirler body 107 and the splitter plate 104 are integrally formed as a single component, and the center body 106 and 306 is formed separately and secured to the swirler body 107. In aspects of the disclosure, the outer shroud 102 can be formed separately from the swirler body 107 and subsequently secured to the swirler body 107. In some aspects of the disclosure, the center body 106, 306 and the outer shroud 102 are welded to the swirler body 107. Alternately, the components of the premixer 100, 200, and 300 can be secured together using other fastening techniques including screw threads, press fitting or the like. Forming the premixer 100, 200, 300 as a three-piece assembly allows for easier access to the splitter plate 104, internal walls of the outer shroud 102, and swirler vanes 210*a* to facilitate machining of the fuel orifices.

The disclosed premixer 100, 200, 300 allows gas turbines which are originally designed for use with natural gas or liquid fuels to operate using hydrogen fuel or a blend of hydrogen and other fuels to minimize CO and NOx emissions for cleaner combustion. The co-swirl swirler body 107 in combination with the disclosed splitter plate 104 and spaced fuel injection orifices provides optimal mixing of fuel and air before combustion and reduces the risk of flashback.

Further aspects of the disclosure are provided by the subject matter of the following clauses.

A premixer for a gas turbine engine, the premixer comprising: an outer shroud including a body defining a channel having an inlet end and an exit end, the inlet end having a first diameter $D_1$ and the exit end having a second diameter $D_2$ that is less than the first diameter $D_1$, the body of the outer shroud having a first constant diameter section that is positioned at the inlet end, a first converging diameter section that extends from the first constant diameter section towards the exit end, and a second constant diameter section that extends from the first converging diameter section towards the exit end, the body having an inner wall including first fuel orifices positioned in an annular array; a swirler body secured to the inlet end of the body of the outer shroud, the swirler body having outer swirlers and inner swirlers spaced radially inward of the outer swirlers; a center body secured to the swirler body and extending along a longitudinal axis of the premixer, the center body defining a central flow channel; and a splitter plate extending from the swirler body, the splitter plate defining an outer air flow channel with the outer shroud and defining an inner air flow channel with the center body, the splitter plate having an inner wall defining second fuel orifices, the second fuel orifices axially and radially spaced from the first fuel orifices.

The premixer according to any preceding clause, wherein the first fuel orifices are formed in the second constant diameter section.

The premixer according to any preceding clause, wherein the outer shroud includes a second converging diameter section that extends from the second constant diameter section toward the exit end and a third constant diameter section that extends from the second converging diameter section to the exit end.

The premixer according to any preceding clause, wherein the first constant diameter section has a length of between about $D_2$ and about $2D_2$.

The premixer according to any preceding clause, wherein the inner and outer swirlers have swirler vanes, and the swirler vanes have angles configured to achieve a swirl number of between about 0.35 and 0.50.

The premixer according to any preceding clause, wherein the swirler vanes have vane heights between about 0.1 $D_2$ and about 0.25 $D_2$.

The premixer according to any preceding clause, wherein the outer swirler includes swirler vanes having leading edges, and the leading edges of the swirler vanes define fuel orifices.

The premixer according to any preceding clause, wherein the center body defines fuel orifices that communicate with the central liquid fuel channel 340, and the fuel orifices are angled outwardly from the longitudinal axis of the premixer to direct fuel towards the inner surface of the splitter plate.

The premixer according to any other clause, wherein the central flow channel of the is an air flow.

The premixer according to any preceding clause, wherein the splitter plate includes a sharp trailing edge.

The premixer according to any preceding clause, wherein the outer shroud defines a fuel plenum that communicates with the first fuel orifices.

The premixer according to any preceding clause, wherein the center body is configured to inject liquid and gaseous fuels.

The premixer according to any preceding clause, wherein the swirler body and the splitter plate define a fuel path that communicates with the second fuel orifices.

A turbine engine comprising: a compressor section, a combustion section, and a turbine section, the combustion section including a plurality of premixers, each of the premixers including: an outer shroud including a body defining a channel having an inlet end and an exit end, the inlet end having a first diameter $D_1$ and the exit end having a second diameter $D_2$ that is less than the first diameter $D_1$, the body of the outer shroud having a first constant diameter section that is positioned at the inlet end, a first converging diameter section that extends from the first constant diameter section towards the exit end, and a second constant diameter section that extends from the first converging diameter section towards the exit end, the body having an inner wall including first fuel orifices positioned in an annular array; a swirler body secured to the inlet end of the body of the outer shroud, the swirler body having outer swirlers and inner swirlers spaced radially inward of the outer swirlers; a center body secured to the swirler body and extending along a longitudinal axis of the premixer, the center body defining a central liquid fuel & air channel; and a splitter plate extending from the swirler body, the splitter plate defining an outer air flow channel with the outer shroud and defining an inner air flow channel with the center body, the splitter plate having an inner wall defining second fuel orifices, the second fuel orifices axially and radially spaced from the first fuel orifices.

The turbine engine according to any preceding clause, wherein the first fuel orifices of the premixer are formed in the second constant diameter section.

The turbine engine according to any preceding clause, wherein the outer shroud of the premixer includes a second converging diameter section that extends from the second constant diameter section toward the exit end and a third constant diameter section that extends from the second converging diameter section to the exit end.

The turbine engine according to any preceding clause, wherein the first constant diameter section has a length of between about $D_2$ and about $2D_2$.

The turbine engine according to any preceding clause, wherein the inner and outer swirlers of the premixer have swirler vanes, the swirler vanes having angles configured to achieve a swirl number of between about 0.35 and 0.50, and the swirler vanes have vane heights between about 0.1 $D_2$ and about 0.25 $D_2$.

The turbine engine according to any preceding clause, wherein the center body defines fuel orifices that communicate with the central flow channel, the fuel orifices angled outwardly from the longitudinal axis of the premixer to direct fuel towards the inner surface of the splitter plate.

The turbine engine according to any preceding clause, wherein the center body defines a portion of an outer annular air channel that is positioned around the central liquid fuel channel The turbine engine according to any preceding clause, wherein the splitter plate includes a sharp trailing edge.

The turbine engine according to any preceding clause, wherein the central flow channel of the center body is an air flow channel.

The turbine engine according to any preceding clause, wherein the splitter plate includes a constant diameter section positioned radially inwardly of the first constant diameter section of the outer shroud and a converging diameter section spaced radially inwardly of the first converging diameter section of the outer shroud.

The turbine engine according to any preceding clause, wherein the splitter plate defines an annular fuel plenum that communicates with the second fuel orifices.

The turbine engine according to any preceding clause, wherein the swirler body defines fuel inlets that communicate with the second fuel orifices.

A method of injecting hydrogen fuel into the turbine engine using the premixer any preceding clause comprising: supplying the hydrogen fuel to the first fuel orifices of the premixer to inject the hydrogen fuel into the outer shroud of the premixer at a first location; and supplying hydrogen fluid to the second fuel orifices to inject the hydrogen fuel into the outer shroud of the premixer at a second location radially and axially spaced from the first location.

The method according to any preceding clause, further including supplying air through the central flow channel of the center body of the premixer.

The method according to any of the preceding clause, further including supplying a liquid fuel to the central flow channel of the center body of the premixer.

The method according to any preceding clause, further including injecting fuel from fuel orifices in the center body into the splitter plate.

The method according to any preceding clause, further including supply air through an annular air flow channel positioned about the central flow channel.

Persons skilled in the art will understand that the structures and methods specifically described herein and shown in the accompanying figures are non-limiting exemplary aspects, and that the description, disclosure, and figures should be construed merely as exemplary of aspects. It is to be understood, therefore, that the disclosure is not limited to the precise aspects described, and that various other changes and modifications may be affected by one skilled in the art without departing from the scope or spirit of the disclosure. Additionally, the elements and features shown or described in connection with certain aspects may be combined with the elements and features of certain other aspects without departing from the scope of the disclosure, and that such modifications and variations are also included within the scope of the disclosure. Accordingly, the subject matter of the disclosure is not limited by what has been particularly shown and described.

What is claimed is:

1. A premixer for a gas turbine engine, the premixer comprising:

an outer shroud including a body defining a channel having an inlet end and an exit end, the inlet end having a first diameter $D_1$ and the exit end having a second diameter $D_2$ that is less than the first diameter $D_1$, the body of the outer shroud having a first constant diameter section that is positioned at the inlet end, a first converging diameter section that extends from the first constant diameter section towards the exit end, and a second constant diameter section that extends from the first converging diameter section towards the exit end, the body having an inner surface including first fuel orifices positioned in an annular array in the second constant diameter section;

a swirler body secured to the inlet end of the body of the outer shroud, the swirler body having outer swirlers and inner swirlers spaced radially inward of the outer swirlers;

a center body secured to the swirler body and extending along a longitudinal axis of the premixer, the center body defining a central flow channel; and a splitter plate extending from the swirler body, the splitter plate defining an outer air flow channel with the outer shroud and defining an inner air flow channel with the center body, the splitter plate having an inner surface defining second fuel orifices positioned upstream of the first converging diameter section of the outer shroud, the second fuel orifices axially and radially spaced from the first fuel orifices.

2. The premixer of claim 1, wherein the outer shroud includes a second converging diameter section that extends from the second constant diameter section toward the exit end and a third constant diameter section that extends from the second converging diameter section to the exit end.

3. The premixer of claim 1, wherein the first constant diameter section has a length of between about $D_2$ and about $2D_2$.

4. The premixer of claim 1, wherein the inner and outer swirlers have swirler vanes, the swirler vanes having angles configured to achieve a swirl number of between about 0.35 and 0.50.

5. The premixer of claim 4, wherein the swirler vanes have vane heights between about 0.1 $D_2$ and about 0.25 $D_2$.

6. The premixer of claim 1, wherein the outer swirler includes swirler vanes having leading edges, the leading edges of the swirler vanes defining fuel orifices.

7. The premixer of claim 1, wherein the center body defines fuel orifices that communicate with the central channel, the fuel orifices angled outwardly from the longitudinal axis of the premixer to direct liquid fuel towards the inner surface of the splitter plate.

8. The premixer of claim 7, wherein the center body defines a portion of an outer annular air channel that is positioned around the central channel.

9. The premixer of claim 1, wherein the splitter plate includes a sharp trailing edge.

10. The premixer of claim 1, wherein the outer shroud defines a fuel plenum that communicates with the first fuel orifices.

11. The premixer of claim 1, wherein the swirler body and the splitter plate define a fuel path that communicates with the second fuel orifices.

12. A turbine engine comprising:

a compressor section, a combustion section, and a turbine section, the combustion section including a plurality of premixers, each of the premixers including:

an outer shroud including a body defining a channel having an inlet end and an exit end, the inlet end having a first diameter $D_1$ and the exit end having a second diameter $D_2$ that is less than the first diameter $D_1$, the body of the outer shroud having a first constant diameter section that is positioned at the inlet end, a first converging diameter section that extends from the first constant diameter section towards the exit end, and a second constant diameter section that extends from the first converging diameter section towards the exit end, the body having an inner surface including first fuel orifices positioned in an annular array downstream of the first converging diameter section of the outer shroud;

a swirler body secured to the inlet end of the body of the outer shroud, the swirler body having outer swirlers and inner swirlers spaced radially inward of the outer swirlers;

a center body secured to the swirler body and extending along a longitudinal axis of the premixer, the center body defining a central flow channel; and a splitter plate extending from the swirler body, the splitter plate defining an outer air flow channel with the outer shroud and defining an inner air flow channel with the center body, the splitter plate having an inner surface defining second fuel orifices, the second fuel orifices axially and radially spaced from the first fuel orifices upstream of the first converging diameter section of the outer shroud.

13. The turbine engine of claim 12, wherein the first fuel orifices of the premixer are formed in the second constant diameter section.

14. The turbine engine of claim 13, wherein the outer shroud of the premixer includes a second converging diameter section that extends from the second constant diameter section toward the exit end and a third constant diameter section that extends from the second converging diameter section to the exit end.

15. The turbine engine of claim 12, wherein the first constant diameter section has a length of between about $D_2$ and about $2D_2$.

16. The turbine engine of claim 12, wherein the inner and outer swirlers of the premixer have swirler vanes, the swirler vanes having angles configured to achieve a swirl number of between about 0.35 and 0.50, and the swirler vanes have vane heights between about 0.1 $D_2$ and about 0.25 $D_2$.

17. The turbine engine of claim 12, wherein the center body defines fuel orifices that communicate with the central channel, the fuel orifices angled outwardly from the longitudinal axis of the premixer to direct fuel towards the inner surface of the splitter plate.

18. The turbine engine of claim 12, wherein the splitter plate includes a sharp trailing edge.

19. A method of injecting hydrogen fuel into the turbine engine of claim 12 comprising:

supplying the hydrogen fuel to the first fuel orifices to inject the hydrogen fuel into the outer shroud of the premixer; and supplying hydrogen fuel to the second fuel orifices to inject the hydrogen fuel into the outer shroud of the premixer, the second fuel orifices radially and axially spaced from the first fuel orifices.

20. The turbine engine of claim 12, wherein the first fuel orifices and the second fuel orifices are directed radially inward.

* * * * *